US011580817B2

(12) United States Patent
Fink et al.

(10) Patent No.: US 11,580,817 B2
(45) **Date of Patent: *Feb. 14, 2023**

(54) LIVE ACTION CRAPS TABLE WITH MIRRORED REMOTE PLAYER STATION

(71) Applicant: Interblock d.d., Menges (SI)

(72) Inventors: Tomaz Fink, Kamnik (SI); Joze Pececnik, Kamnik (SI)

(73) Assignee: INTERBLOCK D.O.O., Menges (SI)

( * ) Notice: Subject to any disclaimer, the term of this patent is extended or adjusted under 35 U.S.C. 154(b) by 0 days.

This patent is subject to a terminal disclaimer.

(21) Appl. No.: 17/318,293

(22) Filed: May 12, 2021

(65) Prior Publication Data

US 2021/0264718 A1 Aug. 26, 2021

Related U.S. Application Data

(63) Continuation of application No. 16/153,141, filed on Oct. 5, 2018, now Pat. No. 11,049,360.

(60) Provisional application No. 62/569,135, filed on Oct. 6, 2017.

(51) Int. Cl.
*G07F 17/32* (2006.01)

(52) U.S. Cl.
CPC ..... *G07F 17/322* (2013.01); *G07F 17/3288* (2013.01)

(58) Field of Classification Search
CPC ..... G07F 17/322; G07F 17/3288
USPC ..... 463/16
See application file for complete search history.

(56) References Cited

U.S. PATENT DOCUMENTS

| | | | |
|---|---|---|---|
| 6,460,848 | B1 | 10/2002 | Soltys et al. |
| 7,559,839 | B2 | 7/2009 | Bahar |
| 8,684,830 | B1 | 4/2014 | Chun |
| 9,990,799 | B2 | 6/2018 | Frost et al. |
| 2003/0232651 | A1 | 12/2003 | Huard et al. |
| 2004/0127284 | A1 | 7/2004 | Walker et al. |
| 2006/0071429 | A1 | 4/2006 | Okujyo et al. |

(Continued)

OTHER PUBLICATIONS

International Patent Application No. PCT/US2018/054752; Int'l Search Report and the Written Opinion; dated Dec. 27, 2018; 16 pages.

(Continued)

*Primary Examiner* — Jay Trent Liddle
*Assistant Examiner* — Ryan Hsu
(74) *Attorney, Agent, or Firm* — BakerHostetler

(57) ABSTRACT

A craps gaming system is described including a craps table and a plurality of consoles. The craps table includes a dealer console configured to control play at the craps table and a shooter console configured to enable a shooter to place bets while also being a shooter. A plurality of player consoles located in close proximity to the craps table and connected over a network to the dealer console and the shooter console each include a display having a graphical user interface and a mechanism for receiving money or credits from a player. The dealer console communicates with each player console and generates a list of players eligible to be the shooter. When a player accepts of an invitation to be the shooter, the dealer console causes the network to mirror the graphical user interface and associated content from an accepting player's player console among the plurality of player consoles to the shooter console.

17 Claims, 4 Drawing Sheets

(56) References Cited

U.S. PATENT DOCUMENTS

| | | | | |
|---|---|---|---|---|
| 2006/0287101 | A1 | 12/2006 | Crawford et al. | |
| 2008/0113706 | A1 | 5/2008 | O'Halloran | |
| 2008/0248864 | A1 | 10/2008 | Toyoda | |
| 2009/0124348 | A1 | 5/2009 | Yoseloff et al. | |
| 2009/0124379 | A1 | 5/2009 | Wells | |
| 2009/0181744 | A1* | 7/2009 | Yoshizawa | G07F 17/32 463/16 |
| 2010/0106766 | A1 | 4/2010 | Bailey et al. | |
| 2013/0225254 | A1 | 8/2013 | Pececnik et al. | |
| 2016/0093138 | A1 | 3/2016 | Munakata et al. | |
| 2016/0093154 | A1* | 3/2016 | Bytnar | G07F 17/3237 463/25 |
| 2017/0154489 | A1 | 6/2017 | Chun | |

OTHER PUBLICATIONS

Nternational Patent Application No. PCT/US2018/054752; Int'l Preliminary Report on Patentability; dated Nov. 25, 2019; 24 pages.

* cited by examiner

LIVE ACTION CRAPS TABLE WITH MIRRORED REMOTE PLAYER STATION

CROSS REFERENCE TO RELATED APPLICATION

This application is a continuation of U.S. patent application Ser. No. 16/153,141, filed Oct. 5, 2018, which claims benefit under 35 U.S.C. § 119(e) of Provisional U.S. Patent Application No. 62/569,135, filed Oct. 6, 2017, the contents of which is incorporated herein by reference in its entirety

BACKGROUND INFORMATION

Craps is a popular wagering game played in casinos and other gaming establishments. In physical versions of the game, players gather around a table about 13 feet long and 5 feet wide with a felt surface and walls about 1 foot high with a padded or rubber surface. The felt surface includes a layout that displays various betting possibilities. Players bet on various betting options by placing chips directly on marked sections of the layout or asked one of the dealers to place the bet for them. The typical bets and outcomes from craps betting are well known.

Once all bets have been placed, one player (called the "shooter") is selected to throw a pair of dice, which are generally picked out of five offered dice, with the remainder not being used. Once the dice have been selected by the shooter, typically no more bets can be placed. For the roll by the shooter to be valid, both dice must typically hit the farthest wall opposite the shooter and remain on the table. A typical craps table requires space for the bank, thousands of chips belonging to the casino and used to pay winning bets and store losing bets and bank chips, and typically requires four dealers to manage the bank, place, pay out and collect bets and manage the dice. As a result of the room required for the bank and the dealers, there is a limited amount of room left for players, which limits the revenue that one craps table can generate.

A stadium craps setting includes a similar table, but requires a single dealer and the shooter. Instead of crowding around the table, the remaining players sit at individual computerized consoles arranged in a stadium configuration around one or both sides of the table. This configuration enables more players to be able to play at each table. Each player can place their bets on a display screen of their console using one or more user interfaces. Bets are placed using credits instead of physical chips and each player can easily place their bets anywhere on the layout without requiring assistance from a dealer. The shooter is chosen from among the players, which causes them to leave their console and come down to the table where the dice can be thrown. Because the player is not at their console, they cannot place any bets while they are shooter, which spoils some of the fun for the player and reduces the revenue that can be generated by the table. Furthermore, because the other players are not at the table, they are often not as aware of when the shooter has selected the dice indicating that the betting cycle has been completed.

TECHNICAL FIELD

The present disclosure relates generally, but not exclusively, to the field of gaming, particularly craps table gaming.

SUMMARY

An embodiment is directed to a craps gaming system including a craps table and a plurality of consoles. The craps table includes a dealer console configured to control play at the craps table and a shooter console configured to enable a shooter to place bets while also being a shooter. A plurality of player consoles located in close proximity to the craps table and connected over a network to the dealer console and the shooter console each include a display having a graphical user interface and a mechanism for receiving money or credits from a player. The dealer console communicates with each player console and generates a list of players eligible to be the shooter. When a player accepts of an invitation to be the shooter, the dealer console causes the network to mirror the graphical user interface and associated content from an accepting player's player console among the plurality of player consoles to the shooter console.

A craps gaming system is directed to a craps table including a dice area and one or more sensors configured to sense when dice are added to the dice area and when dice are removed from the dice area. A plurality of player consoles located in close proximity to the craps table are connected over a network to the one or more sensors. Each player console is configured to enable players to place bets on a craps game played on the craps table. Each player console is configured to disable the player console from accepting further bets on the craps game when a signal is received from the one or more sensors indicating that dice have been removed from the dice area.

These and other features will be more clearly understood from the following detailed description taken in conjunction with the accompanying drawings and claims. This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION OF EMBODIMENTS

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

Disclosed herein are methods, systems, and computer readable storage media that provide for increased guest satisfaction and game revenue generation. Some embodiments of the present invention are described herein in terms of a craps table wagering system for illustrative purposes. However, embodiments of the present invention are not limited to a craps table wagering system, but rather may be implemented in various wagering systems—both automated and manual—that provide similar functionalities as a craps table wagering system.

Figure 1:
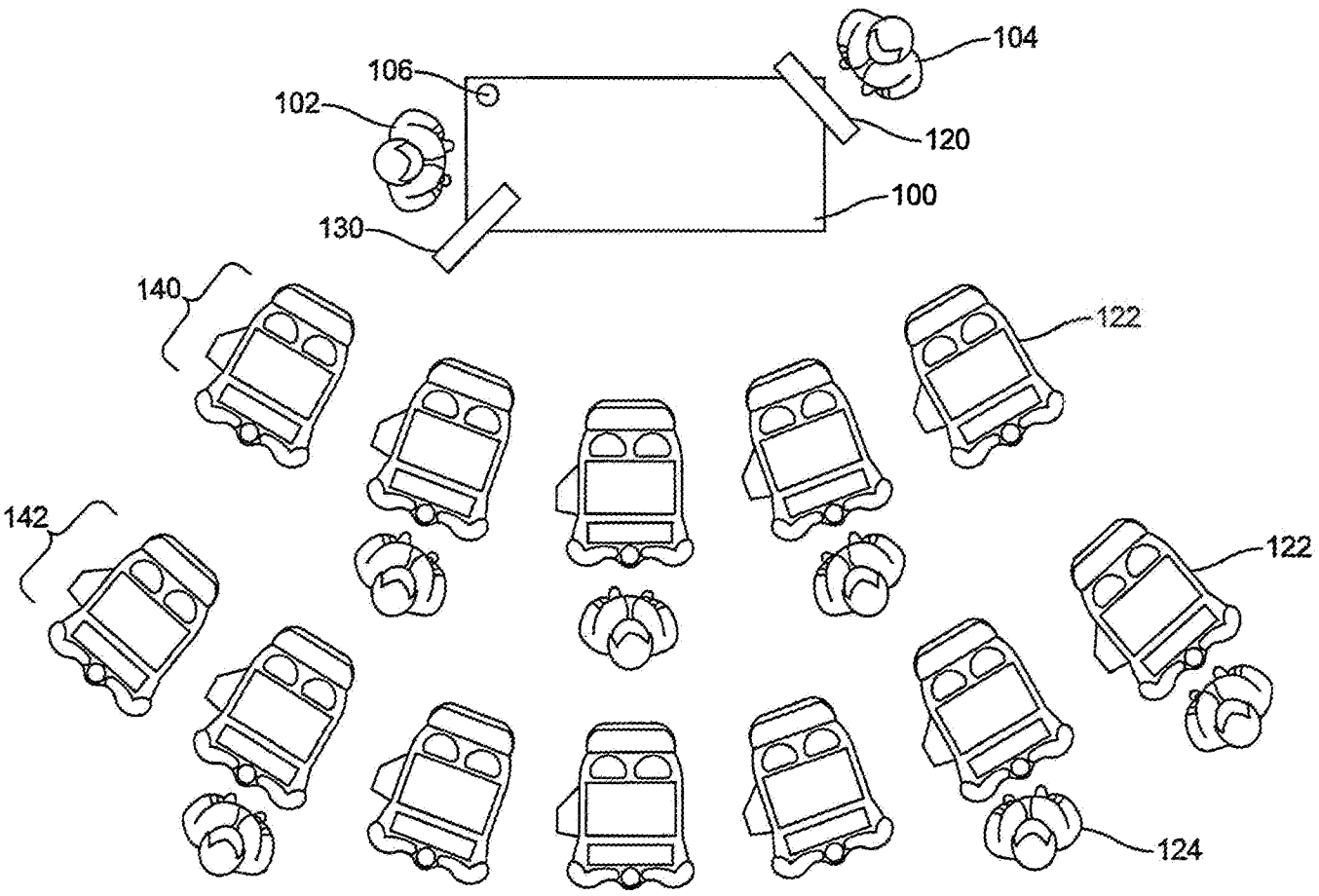
FIG. 1 is a diagrammatic, top view of a craps table in a stadium configuration, in accordance with an embodiment.

FIG. 1 illustrates a craps table set up in a stadium configuration. At the craps table 100 is a typical craps table on which a layout is displayed on which dice can be rolled by a shooter 102. A single dealer 104, called a "croupier," may be positioned at an end of the table opposite the shooter. The dealer may call a player to step up to the table 100 and roll the dice. Once a player steps up to the table 100 to become the shooter, the croupier may walk over and place five dice in a dice area 106 on the table near the shooter 102. Alternatively, the croupier may act as a stickman to control the dice. For example, the croupier may use a long stick to push five dice into the dice area 106. Once the shooter 102 has selected two dice to shoot, the remaining three dice are removed.

Figure 2:
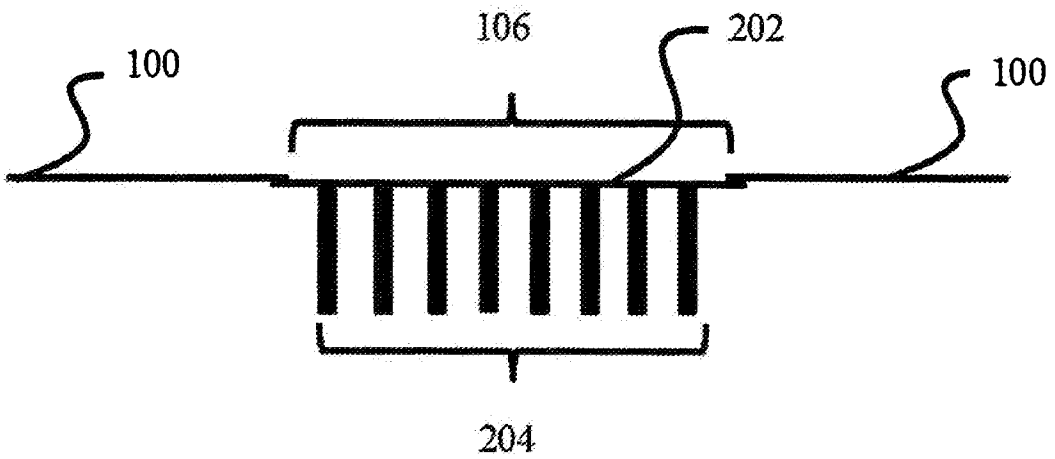
FIG. 2 is a diagrammatic, cross-sectional view of a sensor monitored dice area of a craps table.

In an embodiment, as illustrated in FIG. 2, the dice area 106 may be a surface 202 in the dice area 106 of the craps table 100 that includes capacitive sensors, such as a capacitive surface of glass or similar material. In an embodiment, the capacitive sensors under 204 could be positioned within the table under the dice area 106. In such an embodiment, the surface 202 might be the same as the other felt-like surface of the craps table 100. Any of a number of different types of capacitive sensors could be used, such as a capacitive proximity sensor, which might requires a number of such sensors 204 to fully cover the dice area 106.

Figure 3:
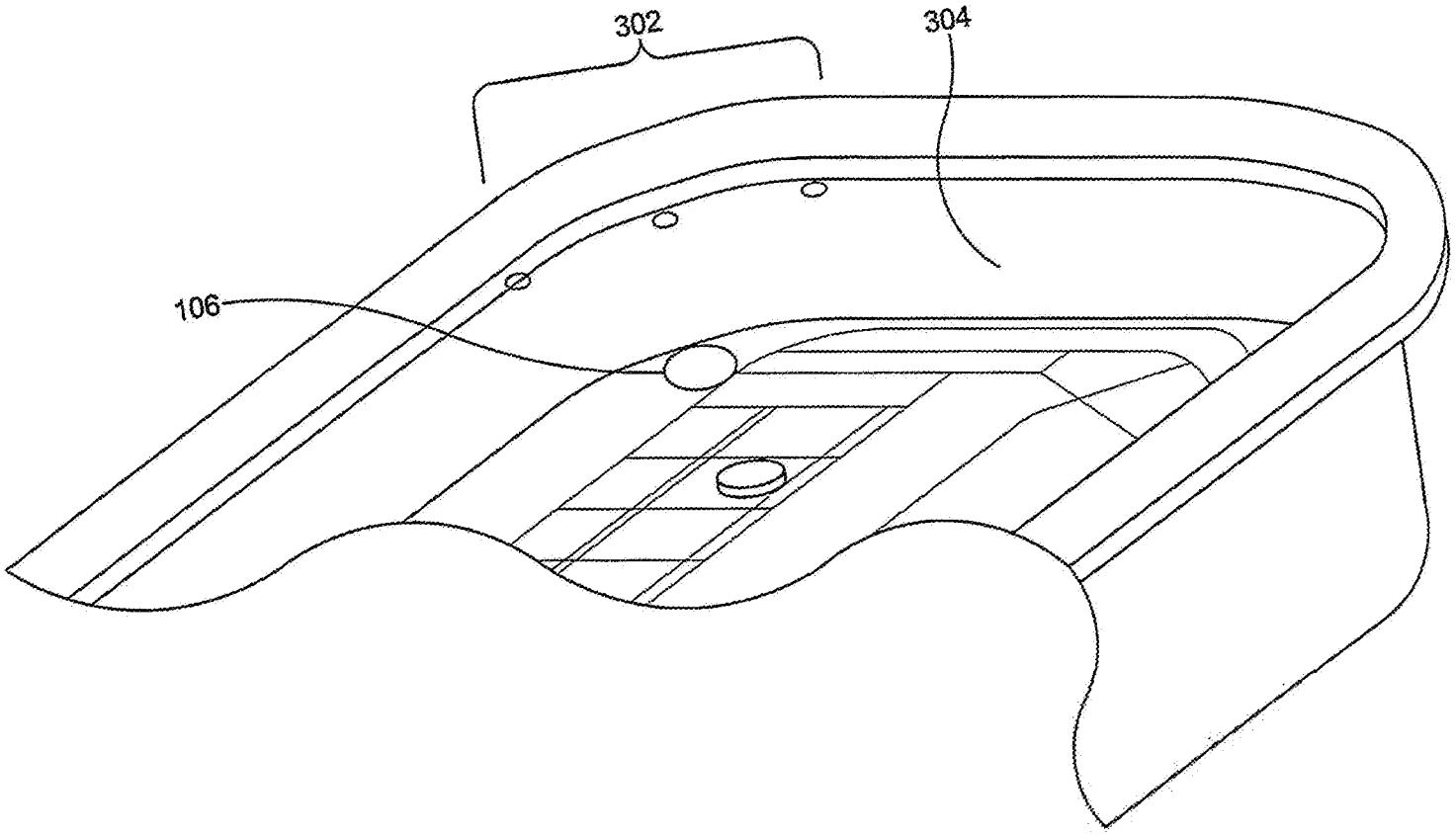
FIG. 3 is a diagrammatic, perspective view of a portion of a craps table illustrating a monitored dice area and optic sensors in the walls of the craps table.

The use of sensors in the dice area prevents the shooter 102 from picking up the dice and making a roll before players have finished making bets, which might give a late betting player an unfair advantage. The sensors therefore detect when any dice are removed from the dice area 106 and send signals out to all of the player consoles and the shooter console that disable further betting. In embodiments, other types of sensors, including optical sensors may be placed in the walls of the table to monitor the dice area 106 from two or three different angles. As illustrated in FIG. 3, the dice area 106 is monitored by three different optical sensors 302, each mounted at a different location and angle around a corner of the wall 304 of the craps table 100. Regardless of the type of sensor used, once the shooter 102 picks up the dice from the monitored dice area 106, the sensors would signal the dealer's console 120 and the consoles 122 of the other players 124 to disable any further bets from being placed.

In an embodiment, the shooter 102 also has a console 130 at the craps table 100 so the shooter can also place bets when operating as the shooter. In order for the shooter to have access to their credits and any other preferences they have made on their player console 122, it is necessary to mirror the shooter's player console 122 to the shooter console 130.

In an embodiment, the croupier selects a player to become the shooter. This is done by viewing the dealer console 120 to see which shooters qualify to become a shooter. In traditional craps this requires a player to have a bet on the Pass line or the Don't Pass line and the same requirement can now be implemented as the shooter can place bets as well. Hence, the dealer may first look for any player that has already placed a bet on the Pass line or Don't Pass line and then invite one of those players to be the shooter by selecting that player's console 122 from a list of consoles or stations listed on the dealer's console 120. Once a player 124 has been selected to be the shooter, a popup message will be displayed on the player's console 122 inviting the player to be the shooter. Not all players want to be the shooter, so the popup message gives the player the option of accepting or declining the invitation.

If the invitation is declined, the dealer may invite the next qualified player. As in traditional craps, where the invitation to be shooter is passed clockwise around the craps table, in the stadium setup, the invitation is also likewise passed clockwise down a row of players. If there are multiple rows of players, the invite may start on a first inside row 140 and then move to the outside row 142, before starting over again on inside row 140. If the invitation is accepted, such as by the player at console 150, the graphical user interface and display for the player console 150 will be transferred to the shooter console 130, essentially mirroring console 150 to shooter console 130, so the exact same content displayed on the player console 150 is displayed on shooter console 130. A variety of techniques for mirroring the graphical user interface and display from one monitor to another monitor on the same network are known in the art. During the time the player console 150 is mirrored, player console 150 is disabled. Once the shooter returns to player console 150, the mirroring is terminated and player console 150 is enabled for use.

When a shooter 102 first steps up to the craps table 100, the shooter 102 is permitted to make additional bets on the shooter console 130. As the shooter console 130 is just a mirror of the graphical user interface and display, the shooter 102 cannot add additional funds as the shooter console is not a fully functional player console with the ability to receive money. If the shooter 102 needs to add money, the shooter will need to return to the player console 150, which the croupier 102 can facilitate through the dealer console 120 by enabling the player console 150. Once the shooter 102 is ready and the game cycle is started, the shooter will pick two dice from the dice area 106 and throw them down the length of the table to the end where the croupier is located. As noted above, the act of selecting two dice from the dice area 106, will stop further betting at the player consoles 122 and the shooter console 130.

As with traditional craps, both dice should hit the wall at the opposite end, although some flexibility may be permitted if at least one dice does so. Once the result of the throw is observed by the croupier 104, the croupier 102 may enter the results of the throw, such as the dice numbers (2 through 12), into the dealer console 120, which will then cause each player station 122 and the shooter station 130 to automatically pay winning bets and collect losing bets, which terminates the game cycle.

The first roll by the shooter 102 is called the come-out roll. If the shooter 102 rolls a 2, 3 or 12, this is called "craps" or "crapping out." If the come-out roll is craps, anyone betting the Pass line loses and anyone betting the Don't Pass line wins if the roll is 2 or 3 and ties or pushes if the roll is 12. The shooter 102 may keep rolling after crapping out. A come-out roll of 7 or 11 is called a "natural;" the Pass line wins and Don't Pass line loses. The other possible numbers are the point numbers: 4, 5, 6, 8, 9, and 10. If the shooter rolls one of these numbers on the come-out roll, this establishes the "point." To "pass" or "win," the point number must be rolled again before a 7. If the shooter rolls any 7 before repeating the point number (a "seven-out"), the Pass line loses, the Don't Pass line wins, and the invitation to be the shooter is passed to the next eligible player. Once the shooter 102 has rolled a seven-out, the game cycle will be completed (i.e., bets payed and collected), mirroring to the shooter console 130 will be terminated the player console 150 will be enabled. Once a new shooter has accepted the invitation to be shooter, the process is repeated.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

Figure 4:
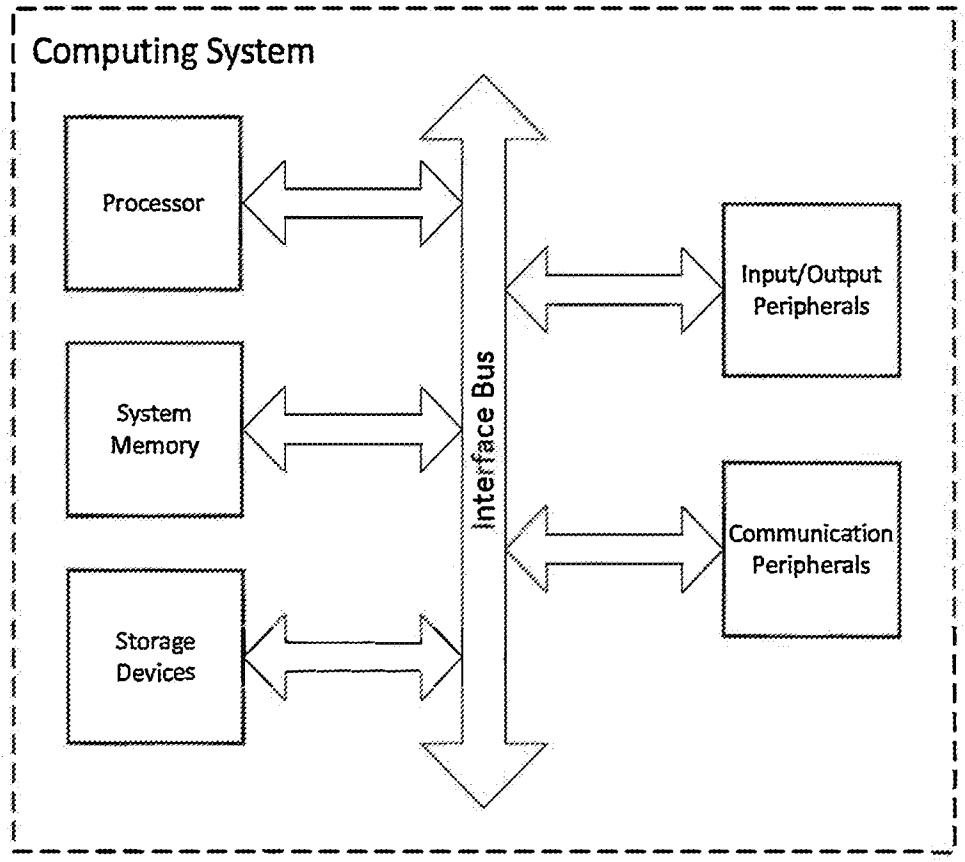
FIG. 4 is an illustration of an exemplary block diagram representing a general purpose computer system in which aspects of the methods and systems disclosed herein or portions thereof may be incorporated.

The techniques described above can be implemented on a computing device associated with a gaming device (e.g., a machine operating a live craps game), a plurality of computing devices associated with a plurality of gaming devices, a controller in communication with the gaming device(s) (e.g., a controller configured to synchronize the gaming devices(s)), or a plurality of controllers in communication with the gaming device(s). Additionally, the techniques may be distributed between the computing device(s) and the controller(s). FIG. 4 illustrates an exemplary block diagram of a computing system that includes hardware modules, software module, and a combination thereof and that can be implemented as the computing device and/or as the server.

In a basic configuration, the computing system may include at least a processor, a system memory, a storage device, input/output peripherals, communication peripherals, and an interface bus. Instructions stored in the memory may be executed by the processor to perform a variety of methods and operations, including the shooter selection and console mirroring, as described above. The computing system components may be present in the gaming device, in a server or other component of a network, or distributed between some combinations of such devices.

The interface bus is configured to communicate, transmit, and transfer data, controls, and commands between the various components of the electronic device. The system memory and the storage device comprise computer readable storage media, such as RAM, ROM, EEPROM, hard-drives, CD-ROMs, optical storage devices, magnetic storage devices, flash memory, and other tangible storage media. Any of such computer readable storage medium can be configured to store instructions or program codes embodying aspects of the disclosure. Additionally, the system memory comprises an operation system and applications. The processor is configured to execute the stored instructions and can comprise, for example, a logical processing unit, a microprocessor, a digital signal processor, and the like.

The system memory and the storage device may also comprise computer readable signal media. A computer readable signal medium may include a propagated data signal with computer readable program code embodied therein. Such a propagated signal may take any of variety of forms including, but not limited to, electro-magnetic, optical, or any combination thereof. A computer readable signal medium may be any computer readable medium that is not a computer readable storage medium and that can communicate, propagate, or transport a program for use in connection with the computing system.

Further, the input and output peripherals include user interfaces such as a keyboard, screen, microphone, speaker, other input/output devices, and computing components such as digital-to-analog and analog-to-digital converters, graphical processing units, serial ports, parallel ports, and universal serial bus. The input/output peripherals may also include a variety of sensors, such as light, proximity, GPS, magnetic field, altitude, and velocity/acceleration. RSSI, and distance sensors, as well as other types of sensors. The input/output peripherals may be connected to the processor through any of the ports coupled to the interface bus.

The user interfaces can be configured to allow a user of the computing system to interact with the computing system. For example, the computing system may include instructions that, when executed, cause the computing system to generate a user interface and carry out other methods and operations that the user can use to provide input to the computing system and to receive an output from the computing system.

This user interface may be in the form of a graphical user interface that is rendered at the screen and that is coupled with audio transmitted on the speaker and microphone and input received at the keyboard. In an embodiment, the user interface can be locally generated at the computing system. In another embodiment, the user interface may be hosted on a remote computing system and rendered at the computing system. For example, the server may generate the user interface and may transmit information related thereto to the computing device that, in turn, renders the user interface to the user. The computing device may, for example, execute a browser or an application that exposes an application program interface (API) at the server to access the user interface hosted on the server.

Finally, the communication peripherals of the computing system are configured to facilitate communication between the computing system and other computing systems (e.g., between the computing device and the server) over a communications network. The communication peripherals include, for example, a network interface controller, modem, various modulators/demodulators and encoders/decoders, wireless and wired interface cards, antenna, and the like.

The communication network includes a network of any type that is suitable for providing communications between the computing device and the server and may comprise a combination of discrete networks which may use different technologies. For example, the communications network includes a cellular network, a WiFi/broadband network, a local area network (LAN), a wide area network (WAN), a telephony network, a fiber-optic network, or combinations thereof. In an example embodiment, the communication network includes the Internet and any networks adapted to communicate with the Internet. The communications network may be also configured as a means for transmitting data between the computing device and the server.

The techniques described above may be embodied in, and fully or partially automated by, code modules executed by one or more computers or computer processors. The code modules may be stored on any type of non-transitory computer-readable medium or computer storage device, such as hard drives, solid state memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

As previously noted, the various features and processes described above may be used independently of one another, or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

The terms and descriptions used above are set forth by way of illustration only and are not meant as limitations. Those skilled in the art will recognize that those and many other variations, enhancements and modifications of the concepts described herein are possible without departing from the underlying principles of the invention. The scope of the invention should therefore be determined only by the following claims and their equivalents.

What is claimed is:

1. A craps gaming system, comprising:

a craps table including a horizontal layout and a vertical wall positioned around the horizontal layout, the vertical wall including a plurality of sensors placed at different locations for monitoring one or more die on the layout, the craps table further including a dealer's console configured to control play at the craps table and a shooter's console configured to enable a shooter to place bets while also being a shooter;

a plurality of player consoles located in close proximity to the craps table and connected over a network to the dealer's console and the shooter's console, each player console among the plurality of player consoles configured to enable betting on a craps game played on the craps table, wherein the dealer's console is further configured to communicate with each player console, and wherein when the plurality of sensors detect any die being removed from a dice area on the layout, the plurality of player consoles and the shooter console are disabled from further betting.

2. The craps gaming system of claim 1, wherein the plurality of sensors are optical sensors.

3. The craps gaming system of claim 2, wherein the optical sensors recognize the one or more dice.

4. The craps gaming system of claim 1, wherein the layout is rectangular with rounded corners and the vertical wall follows contours of the layout, wherein the plurality of sensors are positioned around a corner of the vertical wall to monitor the one or more die from two or three different angles.

5. The craps gaming system of claim 4, wherein the plurality of sensors are optical sensors and each optical sensor is mounted at a different location and angle around the corner.

6. The craps gaming system of claim 5, wherein the plurality of sensors monitor a dice area near the corner.

7. The craps gaming system of claim 6, wherein the plurality of sensors monitor the one or more dice to detect when any die is removed from the dice area.

8. The craps gaming system of claim 1, wherein the plurality of sensors monitor the one or more dice to detect when any die is removed from the layout.

9. A craps gaming system, comprising:

a craps table including a plurality of sensors for monitoring a dice area of a layout of the craps table and configured to sense when one or more die are removed from the dice area, the craps table further including a dealer's console configured to control play at the craps table and a shooter's console configured to enable a shooter to place bets while also being a shooter;

a plurality of player consoles located in close proximity to the craps table and connected over a network to the dealer's console and the shooter's console, each player console among the plurality of player consoles configured to enable betting on a craps game played on the craps table, wherein the dealer's console is further configured to communicate with each player console, and wherein when the plurality of sensors detect any die being removed from the dice area, the plurality of player consoles and the shooter console are disabled from further betting.

10. The craps gaming system of claim 9, wherein the plurality of sensors are placed near the dice area.

11. The craps gaming system of claim 10, wherein the plurality of sensors are placed within the table at the dice area.

12. The craps gaming system of claim 11, wherein the plurality of sensors are capacitive sensors placed under the dice area.

13. The craps gaming system of claim 12, wherein the dice area is covered with a felt-like surface, and wherein the capacitive sensors are capacitive proximity sensors placed under the felt-like surface.

14. The craps gaming system of claim 11, wherein the capacitive sensors are capacitive surface sensors.

15. The craps gaming system of claim 14, wherein a surface of the capacitive surface sensors is glass.

16. The craps gaming system of claim 13, wherein the plurality of sensors monitor the one or more dice to detect when any die is removed from the dice area.

17. The craps gaming system of claim 9, wherein the plurality of sensors are further configured to sense when one or more die are added to the dice area.

* * * * *